US005203039A

United States Patent [19]

Fredman

[11] Patent Number: 5,203,039

[45] Date of Patent: Apr. 20, 1993

[54] ADJUSTABLE CROSS BAR FOR BED RAILS

[75] Inventor: Irving Fredman, University City, Mo.

[73] Assignee: Fredman Brothers Furniture Company, Inc., Peoria, Ill.

[21] Appl. No.: 945,824

[22] Filed: Sep. 15, 1992

[51] Int. Cl.[5] ..... A47C 19/04; A47C 19/02

[52] U.S. Cl. ..... 5/203; 5/202; 5/312; 248/188.4

[58] Field of Search ..... 5/203, 201, 202, 200.1, 5/312, 310, 181, 184, 185, 285, 286, 282.1; 248/188.4

[56] References Cited

U.S. PATENT DOCUMENTS

| | | | |
|---|---|---|---|
| 3,031,689 | 5/1962 | Sark | 5/310 |
| 3,848,280 | 11/1974 | Allen et al. | 5/312 |
| 4,038,710 | 8/1977 | Tambascio | 5/201 |
| 4,080,674 | 3/1978 | Fredman et al. | 5/203 |
| 4,354,287 | 10/1982 | Fredman | 5/202 |

*Primary Examiner*—Alexander Grosz
*Attorney, Agent, or Firm*—Polster, Lieder, Woodruff & Lucchesi

[57] ABSTRACT

A universal cross bar adjustable in length and height to accommodate queen and king size bedding at heights of eight to eighteen inches from the floor with legs which are pivoted into nesting relation with the cross bar for ease in packaging and shipping, and extensions attachable to the cross bar to increase its length and to the legs to raise the height of the cross bar. A plastic bushing having a threaded throughbore is positioned in an opening formed in the bottom of the leg by a "W" shaped bracket riveted to the leg and a foot having a threaded stem which fits in the throughbore is used to further adjust the height of the cross bar.

13 Claims, 2 Drawing Sheets

ADJUSTABLE CROSS BAR FOR BED RAILS

BACKGROUND OF THE INVENTION

1. Field of the Invention

This invention relates to beds with wooden bed rails and more particularly to a rigid center support system with legs to carry the wider and heavier queen and king (sixty and seventy six inch widths, respectively) bedding now in extensive use in the industry.

This invention also relates to a universal bed rail support system which is usable with the higher off the floor style beds currently in fashion. These beds require legs of heights from eight inches to eighteen inches which is the distance from the lip of the bed rail to the floor. These beds conventionally have wood side rails and it is to this field that this invention is specifically directed.

2. Description of the Prior Art

Conventional beds and bed rails require longitudinally spaced, transversely extending wooden or metal slats extending between the rails. Such rails warped, twisted outward or deflected under the weight of the box spring and other bedding components which allowed the box spring to sag. This especially became a problem with wider span beds and bedding, such as, sixty inch standard width (queen size) or seventy six inch width (king size) instead of fifty three inch full size width, since the wider bedding is heavier as well as being wider and longer. Slats setting on angle iron or wood rails not only pushed the rails downward but also pushed the rails outwardly when weight was placed on the slats This is a critical problem as the twisting or torquing of the rails frequently caused the bed legs to split when the slot in the legs of the beds is too close to the outside edge of the leg, or caused the bed legs to split away from the end board.

Prior U.S. Pat. No. 4,080,674 issued Jan. 3, 1977 discloses me al bed rails for queen size beds which eliminate the use of transverse slats and are interconnected by a centrally located angle iron rigid cross member with legs and adjustable glides. By extending the threaded glides to contact the floor they prevent the boxspring from sagging.

It is the primary object of this invention to provide a universal bed rail support system that will fit all queen and king size beds which use wood rails, and not depend on custom cutting wood slats for each varying width bed or taking the risk of placing the boxspring directly on the cleat or lip of the wood rail. A further and more specific object of the invention is to provide a rigid center support system with legs which are adjustable in height from eight to eighteen inches for queen size beds and bedding as is recommended by the bedding industry to protect the wider queen and king size boxsprings from warping or sagging.

A further object is to provide a cross bar for beds having wood side rails with legs which are adjustable in height and which fold into the cross bar for shipping and are pivoted to provide easy erection by the user. Still another object is to provide an economical and sturdy leg which is adjustable in height and is easily assembled by the user. A further object is to provide a cross bar which is adjustable in width to accommodate both queen and king size beds and still can be packaged in a compact inexpensive package. These and other objects and advantages will become apparent hereinafter.

SUMMARY OF THE INVENTION

This invention comprises a universal cross bar for beds with wood side rails which is adjustable in height for beds in which the lip of the side rail is from eight to eighteen inches from the floor and is usable with both queen and king size beds.

DESCRIPTION OF THE DRAWINGS

In the drawings wherein like numbers refer to like parts wherever they occur.

DETAILED DESCRIPTION

Figures 1, 2, 3:
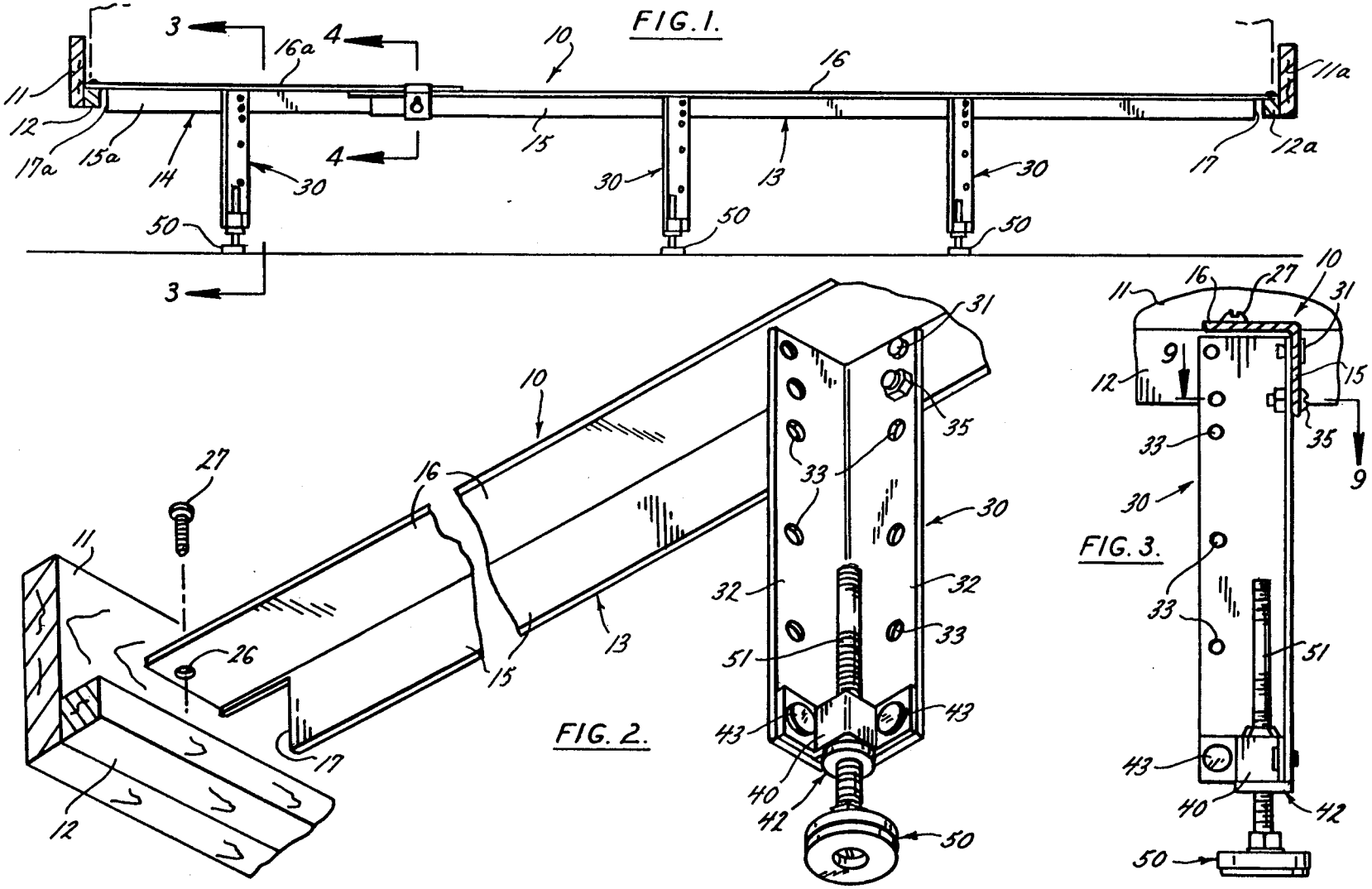
FIG. 1 is a vertical sectional view taken through a king size bed construction showing the side rails in section.
FIG. 2 is a fragmentary exploded perspective view showing attachment of the cross bar to a side rail.
FIG. 3 is a fragmentary elevation view partly in section of the erected leg connected to the cross bar.

FIGS. 1 and 2 show a universal cross bar 10 which is adaptable to be attached to the wooden side rails 11,11*a* of a conventional bed. The side rails 11,11*a* connect a headboard and a footboard, neither of which is shown. The wooden side rails 11,11*a* have wooden lips or cleats 12,12*a* which run their entire length. The cleats 12,12*a* support the cross bar 10. Only one cross bar is described, but it is understood that normally two cross bars are used and recommended by the bed manufacturer. For king size beds, three cross bars may be used.

The cross bar 10 may be formed from two sections, a main section 13 and an extensible section 14. Both of the sections 13 and 14 are identical "L" shaped angle irons and have side flange 15,15*a* and a top flange 16, 16*a*, respectively. The main section 13 is sized to fit a queen size bed in width and the purpose of the extensible section 14 is to extend the size of the main section 13 to fit a king size bed. The main section 13 is used alone when the cross bar is to be used with a queen size bed, whereas the extension 14 is added to the main section 13 when the cross bar 10 is to be used with a king size bed.

The side flange 15 of the main section 13 has a cutout segment 17 on each end. The purpose of the cutout segment 17 is to allow the top flange 16 to be positioned directly on the cleats 12 when used with queen size bedding. The width of the cutout segment 17 is such as to accommodate the width of the cleat 12. The free end of the extensible section side flange 15*a* also has a cutout 17*a* which, in turn, allows the extensible section top flange 16*a* to reside directly on the top surface of the cleat 12 when used with king size bedding.

Figures 4, 5, 6, 7, 8, 9, 10:
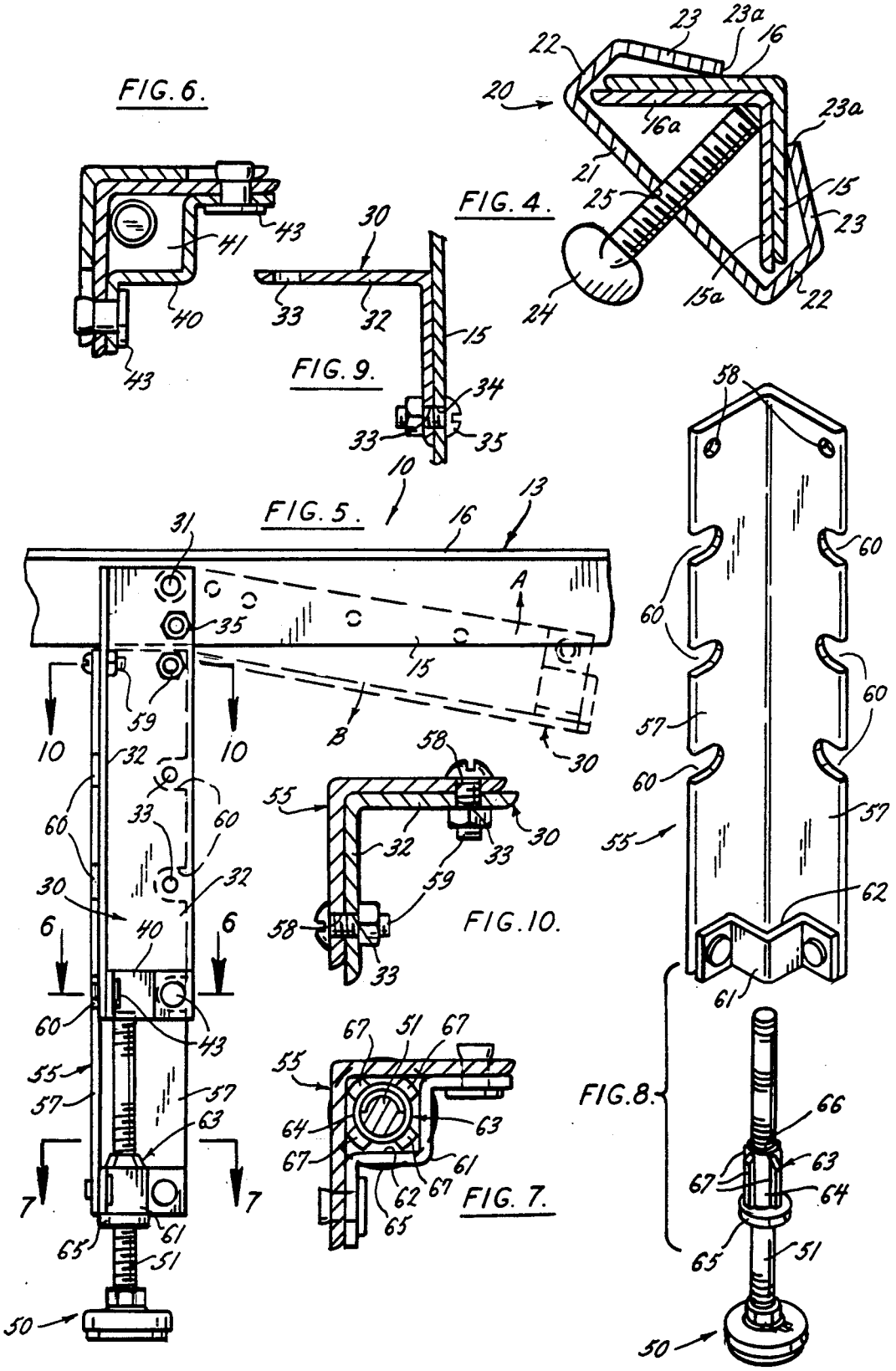
FIG. 4 is a sectional view taken along line 4—4 of FIG. 1.
FIG. 5 is a fragmentary elevational view of a leg with an extension attached.
FIG. 6 is a sectional view taken along line 6—6 of FIG. 5.
FIG. 7 is a sectional view taken along line 7—7 of FIG. 5.
FIG. 8 is an exploded view showing attachment of extensible leg to the extension member.
FIG. 9 is a fragmentary sectional view taken along line 9—9 of FIG. 3.
FIG. 10 is a sectional view taken along line 10—10 of FIG. 5.

FIG. 4 shows the connection between the extensible section 14 and the main section 13. This includes a generally " " shaped clamp member 20 which has a base segment 21, upstanding arms 22 and inwardly and angularly directed flanges 23. The free ends 23*a* of the flanges 23 engage the surfaces 15*a* and 16*a* of the extensible section side flange 15*a* and extensible section top flange 16*a*, respectively. A thumb screw 24 is threaded into a threaded opening 25 in the base 21 and is moved into engagement with the juncture of the inner surfaces of the main section side and top flanges 15, 16, respectively, to urge the clamp 20 into engagement with both the main section 13 and the extensible section 14 to hold said sections in fixed extended position.

To add the extensible section 14 to the main section 13, one merely positions the clamp 20 by sliding it over the ends of the sections 13, 14 and tightens the screw 24 down when the size between the side rails 11,11*a* is determined. The end of the screw 24 bears against the juncture where the main section flanges 15 and 16 intersect, and the inwardly directed clamp flange ends 23*a* engage the outer surfaces of the extension member flanges 15*a* and 16*a* to hold the main section and the extension section in fixed position.

The ends of the top main section flange 16 are provided with openings 26 through which a fastening screw 27 is positioned to attach the cross bar 10 to the cleats 12,12*a* when in queen size configuration. The extension section 14 has a similar opening 26 at the end of the top flange 16*a* to accommodate the screw 27 when the cross bar 10 is in king size configuration (FIG. 2).

Both the main section 13 and the extensible section 14 are provided with adjustable legs 30. The main section 13 has two legs 30 and the extensible section 14 has one leg 30. The legs 30 are all identical and are formed of "L" shaped angle iron and are pivotally connected at 31 to the side flanges 15,15*a*, respectively. The flanges 32 of the leg 30 are approximately the same size as the flanges 15,15*a*, 16,16*a*, whereby the legs 30 can be moved into nested arrangement with the cross bar main section 13 and the cross bar extension section 14 for easy shipping and packing. FIG. 5 shows the legs movable from the phantom position toward shipping and full erected solid line position. The legs are pivoted in the direction "A" of FIG. 5 to shipping condition, and in direction of arrow "B" of FIG. 5 to erected position. The legs are provided with a series of spaced openings 33 in the flanges 32. The upper most opening 33 is adjacent to the pivot 31 and is aligned with an opening 34 in the side flanges 15, 15*a* (FIG. 9). A bolt and nut, or other suitable fastening means 35, is positioned through the openings 33, 34 to retain the legs 30 in erected position. The fastening means 35 can be removed, if the cross bar 10 is disassembled.

Positioned at the free end of each of the legs 30 is a "W" shaped bracket 40 which, together with portions of the leg flanges 32, defines a square opening 41 which is designed to accommodate a bushing 42. The bracket 40 is fastened to the leg 30 by rivets 43. The riveting of the bracket 40 to the leg 30 provides a reliable and inexpensive method, as compared to conventional spot welding, for attaching the bracket 40 to the leg 30. This is shown in FIGS. 2 and 3 and the bushing 42 is shown in more detail in FIGS. 7 and 8 where it is shown in conjunction with a leg extension member 55.

The insert bushing 42 is identical to the extension member bushing 63 and will be described in detail hereinafter.

FIGS. 5, 6, 7 and 8 show an extension member 55 which is adapted to be attached to a leg 30 to extend the distance from the cross bar 10 to the surface on which the bed is placed. The extension member 55 allows the cross bar to be used on beds which have heights of about eight to about eighteen inches from the floor which beds are currently used with wooden side rails. The extension member 55 is very similar to the leg 30 in construction and has an "L" angle body 56 which is defined by two right angular side flanges 57. The flanges 57 have opposed aligned openings 58 adjacent to the top ends for attachment to corresponding openings 33 in the main legs 30.

Suitable fastening means 59 are positioned through each of the openings 58 to securely engage the extension member 55 to the legs 30 (FIG. 10).

The side flanges 57 are provided with a series of spaced cutout areas 60 along their outer edges (FIG. 8). The cutout openings 60 are designed to accommodate the enlarged ends of the rivets 43 which hold the bracket 40 in the main legs 30.

The free end of the extension member 55 has a "W" shaped bracket 61 (FIG. 8) positioned at the free end thereof which defines a square opening 62 to accommodate an independent plastic insert 63. The insert 63 is similar to the insert or bushing 42 and is designed to accommodate a foot 50. The insert 63 comprises a body member 64 which is designed to fit inside the opening 61. The body member 64 has a flange 65 on one end thereof which is larger than the opening 62 and a threaded throughbore 66 extends through the flange 65 and the body member 64. External ribs 67 are positioned around the outer periphery of the body member 64 and are adapted to engage and be compressed within the opening 62 to thereby retain the insert 63 in said opening 62. The construction and arrangement of bracket 40 and the bushing 42 is identical to that described for the bracket 61 and the bushing 63.

The foot member 50 has a threaded stem 51 extending therefrom is engaged in the threaded throughbore 66 and provides an adjustable leg in which the distance from the foot 50 to the cross bar 10 can be finely adjusted by threading the stem 51 through the threaded throughbore 66. The association and cooperation of the bushing 42 and the foot 50 is the same for the member 30 when it is used without the extension 55.

The free end of the stem 51 on the foot 50 is designed to pass into the opening 41 defined by the bracket 40 in the main leg 30. Thus, by using the extension 55, the cross bar 10 can be used with beds that have side rails any where from eight to eighteen inches from the floor.

The invention is intended to cover all changes and modifications of the example of the invention herein chosen for purposes of the disclosure which do not constitute departures from the spirit and scope of the invention.

What is claimed is:

1. A universal cross bar adjustable in height for interconnecting the side rails of a queen size bed wherein the side rails are wood and have opposed horizontal flanges on which the cross bar resides comprising:

a) an "L" angle cross bar having horizontal and vertical webs with notches cut out of the vertical web at the ends whereby the horizontal web lies flat on the side rail horizontal flanges, b) an "L" angle leg having flanges and being pivotally connected to the vertical web intermediate its ends and movable into a nested position with the cross bar from an extended operating position perpendicular to the cross bar, c) means for securing the leg in operating position, d) a "W" bracket positioned inside the "L" angle leg at the free end thereof and defining therewith a square opening, e) a plastic insert positionable in the opening defined by the bracket and the leg, said insert having 1) a body member adapted to fit in the opening, 2) a flange larger than the opening at one end of the body, and 3) a threaded throughbore through the flange and the body member, and f) a foot having a threaded stem extending therefrom and adapted to engage the threaded throughbore to provide an adjustable leg in which the distance from the foot to the bar can be adjusted by threading the stem through the threaded throughbore.

2. The cross bar of claim 1 wherein the means for securing the leg in operating position includes aligned openings in the cross bar vertical web and one flange of the leg and means for interconnecting the openings.

3. The cross bar of claim 1 wherein the "W" shaped bracket is secured to the leg by rivets through the bracket flanges and the flanges of the leg with the ends of the rivets on the outsides of the leg flanges.

4. The cross bar of claim 1 including an extension member for the cross bar to fit a king size bed.

5. The cross bar of claim 4 including a second "L" angle leg pivotally fastened to the vertical flange of the extension member and means for maintaining the leg in erected position at right angles to the extension member.

6. The cross bar of claim 1 including two legs pivotally secured to the cross bar.

7. The cross bar of claim 1 wherein the insert has external ribs on the body member adapted to engage the square opening and hold the insert in the opening.

8. A universal cross bar adjustable in height for interconnecting the side rails of a queen size bed wherein the side rails are wood and have opposed horizontal flanges on which the cross bar resides comprising:

a) an "L" angle cross bar having vertical and horizontal webs and notches cut out of the vertical web at the ends whereby the horizontal web lies flat on the side rail horizontal flanges, b) "L" angle main leg having right angular flanges and being pivotally connected to the vertical web intermediate its ends and movable into a nested position with the cross bar from an extended operating position perpendicular to the cross bar, c) means for securing the leg in operating position, d) the leg flanges being provided with a series of aligned spaced openings, e) a "W" bracket positioned inside the "L" angle leg at the free end thereof and defining therewith a square opening, the bracket being attached to the leg by rivet means through the free flanges of the bracket and the leg flanges with the ends of the rivets on the outside of the leg flanges, f) an extension member adapted to be attached to the leg to extend the distance from the cross bar to the surface on which the bed is placed to accommodate bed heights of greater than eight inches, said extension member comprising 1) an "L" angle body, 2) opposed openings in the two sides of the "L" angle adjacent to the top end for attachment to corresponding openings in the main leg, 3) a series of aligned spaced open ended cutouts in the edges of the two sides of the extension member to accommodate the ends of the rivets holding the "W" shaped bracket in the main leg, 4) a "W" shaped bracket positioned inside the "L" angle of the extension member at the free end and defining a square opening therewith, g) a plastic insert positionable in the square opening defined by the bracket and the extension member, said insert having 1) a body member adapted to fit in the square opening, 2) a flange larger than the opening at one end of the body, and 3) a threaded throughbore through the flange and the body member, and h) a foot having a threaded stem extending therefrom and adapted to engage the threaded throughbore to provide an adjustable leg in which the distance from the foot to the bar can be adjusted by threading the stem through the threaded throughbore.

9. The cross bar of claim 8 wherein the means for securing the leg in operating position include aligned opening in the cross bar vertical web and one flange of the main leg and means for interconnecting the openings.

10. The cross bar of claim 8 including two main leg extensions and feet.

11. The cross bar of claim 8 including an extension member for the cross bar to accommodate king size beds comprising 1) an "L" angle having the vertical flange notched at the end thereof to accommodate the side rail horizontal flange, 2) a further "L" angle leg pivotally fastened to the vertical flange of the extension member and having the extension member, plastic insert and foot defined in claim 8, and fastening means for retaining the cross bar and extension member in fixed position.

12. The cross bar of claim 11 wherein the fastening means comprises 1) a " " shaped clamp adapted to slip over the nested "L" angle of the bar and extension member, and 2) a threaded member through the center portion of the clamp and adapted to engage the inside of the cross bar at the juncture of the horizontal and vertical webs to hold the cross bar and the extension member together.

13. The cross bar of claim 8 wherein the body member has external ribs adapted to engage the square opening and hold the insert in the opening.

* * * * *

UNITED STATES PATENT AND TRADEMARK OFFICE

CERTIFICATE OF CORRECTION

PATENT NO. : 5,203,039

DATED : April 20, 1993

INVENTOR(S) : Irving Fredman

It is certified that error appears in the above-identified patent and that said Letters Patent is hereby corrected as shown below:

Column 1, line 34, "slats This" should read -- slats. This --;

Column 1, line 41, "me al" should read -- metal --;

Column 3, line 3, "' ' shaped" should read -- "⊂" shaped --;

Column 6, line 52, "a ' shaped" should read
-- a "⊂" shaped --

Signed and Sealed this

Eleventh Day of January, 1994

*Attest:*

*Attesting Officer*

BRUCE LEHMAN

*Commissioner of Patents and Trademarks*